US008516624B2

(12) United States Patent
Klimaschewski

(10) Patent No.: US 8,516,624 B2
(45) Date of Patent: Aug. 27, 2013

(54) ARTIFICIAL SURFING FACILITY

(75) Inventor: Rainer Klimaschewski, Gräfelfing (DE)

(73) Assignee: Action Team Veranstaltungs GmbH, Martinsried (DE)

( * ) Notice: Subject to any disclaimer, the term of this patent is extended or adjusted under 35 U.S.C. 154(b) by 279 days.

(21) Appl. No.: 13/002,586

(22) PCT Filed: Nov. 17, 2009

(86) PCT No.: PCT/EP2009/008177

§ 371 (c)(1),
(2), (4) Date: Jan. 4, 2011

(87) PCT Pub. No.: WO2010/054850

PCT Pub. Date: May 20, 2010

(65) Prior Publication Data

US 2011/0099707 A1 May 5, 2011

(30) Foreign Application Priority Data

Nov. 17, 2008 (DE) ..... 10 2008 057 785

(51) Int. Cl.

| | |
|---|---|
| ***A47K 3/10*** | (2006.01) |
| ***E02B 3/00*** | (2006.01) |
| ***E02B 13/00*** | (2006.01) |
| ***A63G 9/00*** | (2006.01) |

(52) U.S. Cl.
USPC ..... 4/491; 405/79; 405/52; 472/128

(58) Field of Classification Search
USPC ..... 4/491; 405/79, 87; 472/117
See application file for complete search history.

(56) References Cited

U.S. PATENT DOCUMENTS

| | | | |
|---|---|---|---|
| 6,019,547 | A | 2/2000 | Hill |
| 6,629,803 | B1 | 10/2003 | McFarland |
| 6,932,541 | B2 | 8/2005 | McFarland |

(Continued)

FOREIGN PATENT DOCUMENTS

| | | | |
|---|---|---|---|
| DE | 88 05 174 | U1 | 6/1988 |
| DE | 94 00 662 | U1 | 3/1994 |

(Continued)

OTHER PUBLICATIONS

U.S. Appl. No. 61/022,680, filed Jan. 22, 2008.

*Primary Examiner* — Greg Huson
*Assistant Examiner* — Christine Skubinna
(74) *Attorney, Agent, or Firm* — Roberts Mlotkowski Safran & Cole, P.C.; David S. Safran

(57) ABSTRACT

An artificial surfing facility for producing a standing wave, with an inclined ramp, to the upper end of which water is conveyed by at least one pump and at the lower end of which the water discharges into a wave pool. A standing wave is easily attained by there being an adjustable guide device in the wave pool at a distance from the bottom end of the ramp in the flow direction as a wave initiator. The wave pool, during operation of at least one pump, has a liquid level which is located above the liquid level of a main pool which surrounds the wave pool and the amount of water in the wave pool offers a defined resistance to the water flowing down the ramp so that the formation and height of the standing wave are influenced by the change of the flow velocity.

18 Claims, 4 Drawing Sheets

(56) References Cited

U.S. PATENT DOCUMENTS

| | | | | |
|---|---|---|---|---|
| 7,144,197 | B2 * | 12/2006 | Black | 405/79 |
| 7,326,001 | B2 | 2/2008 | McFarland | |
| 7,568,859 | B2 | 8/2009 | McFarland | |
| 7,658,571 | B2 * | 2/2010 | McFarland | 405/79 |
| 7,722,291 | B2 | 5/2010 | McFarland | |
| 7,815,396 | B2 | 10/2010 | McFarland et al. | |
| 8,303,213 | B2 | 11/2012 | McFarland | |
| 2003/0180095 | A1 * | 9/2003 | McFarland | 405/79 |
| 2008/0286047 | A1 * | 11/2008 | Carnahan et al. | 405/79 |
| 2010/0135727 | A1 | 6/2010 | McFarland | |

FOREIGN PATENT DOCUMENTS

| | | | |
|---|---|---|---|
| DE | 299 17 103 | U1 | 12/1999 |
| JP | 5-346070 | A | 12/1993 |
| WO | 2004/076779 | A1 | 9/2004 |
| WO | 2008/034631 | A1 | 3/2008 |

* cited by examiner

ARTIFICIAL SURFING FACILITY

BACKGROUND OF THE INVENTION

1. Field of the Invention

The invention relates to a transportable or fixed artificial surfing facility for producing a standing wave with an inclined ramp to whose upper end water is conveyed over a flow section by means of at least one pump and whose lower end discharges the water into a wave pool.

2. Description of Related Art

A surfing facility of the type indicated above is known from U.S. Pat. No. 6,019,547. In it, the water flows down a fixed inclined plane and strikes two stationary flow-shaping elements that are arranged spaced apart from one another in succession and produce a standing wave on a rising flank of the second element. Fixed internals mean increased cost and offer less variability with respect to the shape and height of the resulting wave.

SUMMARY OF THE INVENTION

The object of the invention is to devise an artificial surfing facility by means of which standing waves of various shape and height can be produced.

This object is achieved by a surfing facility in which there is an adjustable guide device in the wave pool at a distance from the bottom end of the ramp in the flow direction, the wave pool during operation of at least one pump having a liquid level which is located above the liquid level of a main pool which surrounds the wave pool and the amount of water in the wave pool offering a defined resistance to the water flowing down the ramp so that the formation and height of the standing wave are influenced by the change of the flow velocity.

In accordance with the invention, a standing wave is produced by the inclined plane in the form of a ramp being connected at its upper end to a flow section which makes the flow uniform and its bottom end is supported in a wave pool. The standing wave in the surfing facility in accordance with the invention is produced by the water flowing rapidly down the ramp being routed via at least one adjustable guide device which is located at a distance from the bottom end of the ramp in the flow direction. The wave height is also influenced by the water flowing rapidly down the ramp striking a defined mass of relatively more slowly flowing water in the wave pool and in this way being forced up. A standing wave is formed by the resulting change of the flow velocity.

The water level in the wave pool is preferably adjustable by an adjustable overflow. This water level influences the formation and height of the wave since the amount of water in the wave pool offers a defined resistance to the water flowing down the ramp.

It is advantageously provided that several pump units located next to one another are upstream of the flow section. The flow section constitutes a relatively large reservoir which homogenizes the amount of water which has been delivered by the different pump units. In this way, at a smaller water demand, to produce a lower wave which is suitable for beginning surfers, for example, individual pumps can also be throttled in their delivery rate or turned completely off without this leading to a different layer thickness of the water flow, viewed over the width of the ramp.

The side walls of the flow section and likewise also the side walls in the region of the ramp can optionally be arranged preferably to form a constriction to whose width preferably the wave pool, with side walls which can be moved relative to one another, can also be adapted. In addition to regulating the amount of water delivery, this yields further possibilities of influencing the standing wave. Thus, adaptation of its height for various performance levels of the surfer is also possible.

In a mobile surfing facility with a limited amount of circulating water, it is especially advantageous if the wave pool, the pump chambers, and the collecting space are surrounded by a main pool. Separation of the wave pool which is located higher than the main pool, moreover, ensures that only a defined mass of water—specifically that in the wave pool—forms the resistance for the water flowing down the ramp. Formation of the standing wave can thus be computed much better and can be more uniquely reproduced.

Preferably, each of the several pump units is provided with a respective pump which intakes water out of the main pool and delivers it to the flow section upstream of the ramp. To regulate the total amount of water delivered to the flow section, the delivery rate of the pumps can preferably be adjusted and/or several pumps can be turned on and off individually or in groups.

The guide device, according to a first embodiment, is formed by a guide profile which can preferably be changed not only in its angle of incidence with respect to the flow, but also in its distance relative to the lower end of the ramp. Optionally, the length of the guide profile can also be changed by parts which can be telescoped relative to one another.

It is especially preferably provided that the guide profile be divided into several adjacent guide profiles over the width of the wave pool. The several adjacent guide profiles can be arranged transversely or obliquely relative to the flow at various positions along the length and/or over the width of the wave pool to influence the shape of the wave. This arrangement at different positions is facilitated by there being several holding device or guides for attachment, or preferably for movable support, of the guide profiles on the bottom of the wave pool.

The guide profiles are pivoted in the region of their front edges and their rear edge can be displaced by means of an adjusting mechanism. The adjusting mechanism can be formed, for example, by a pneumatic cylinder.

In one version, the guide profiles are supported to float freely at least in one part of their pivoting region. Here, for example, by means of an adjusting mechanism a first raising motion of the rear edge takes place and the remainder of the raising motion arises as a result of the flow-induced negative pressure on the top of the guide profiles. A limitation, for example, in the form of an adjustable belt which is preferably located between the rear edge of the guide profile and the bottom of the wave pool can usefully limit the maximum raising angle so that sudden chopping of the flow and collapsing of the wave do not occur. In contrast to the relatively large wave-shaping bodies located near the water surface in the initially named prior art, the end profile is not located in the region of the standing wave ridden by the surfers, but in the bottom region of the wave pool so that fall-induced injuries cannot be caused by this part.

Another adjustment possibility for the wave can be formed by the height of the upper bearing of the ramp together with the flow section being displaceable by means of an adjusting mechanism.

Finally, the wave can also be advantageously influenced by the water level in the wave pool being adjustable by an overflow which is preferably adjustable by means of an adjusting mechanism on its rear wall which is downstream from the lower end of the ramp, from where the water flows back into the main pool. The backflow eddy which arises by this backpressure on the back makes it easier for a surfer who has fallen off the board to stand in the region of the wave pool downstream of the wave and to climb out of the wave pool.

Exemplary embodiments of the surfing facility in accordance with the invention are explained in detail below with reference to the accompanying drawings.

BRIEF DESCRIPTION OF THE DRAWINGS

FIG. 2 shows a schematic longitudinal section through the surfing facility with the pumps turned on;

DETAILED DESCRIPTION OF THE INVENTION

Figure 1:
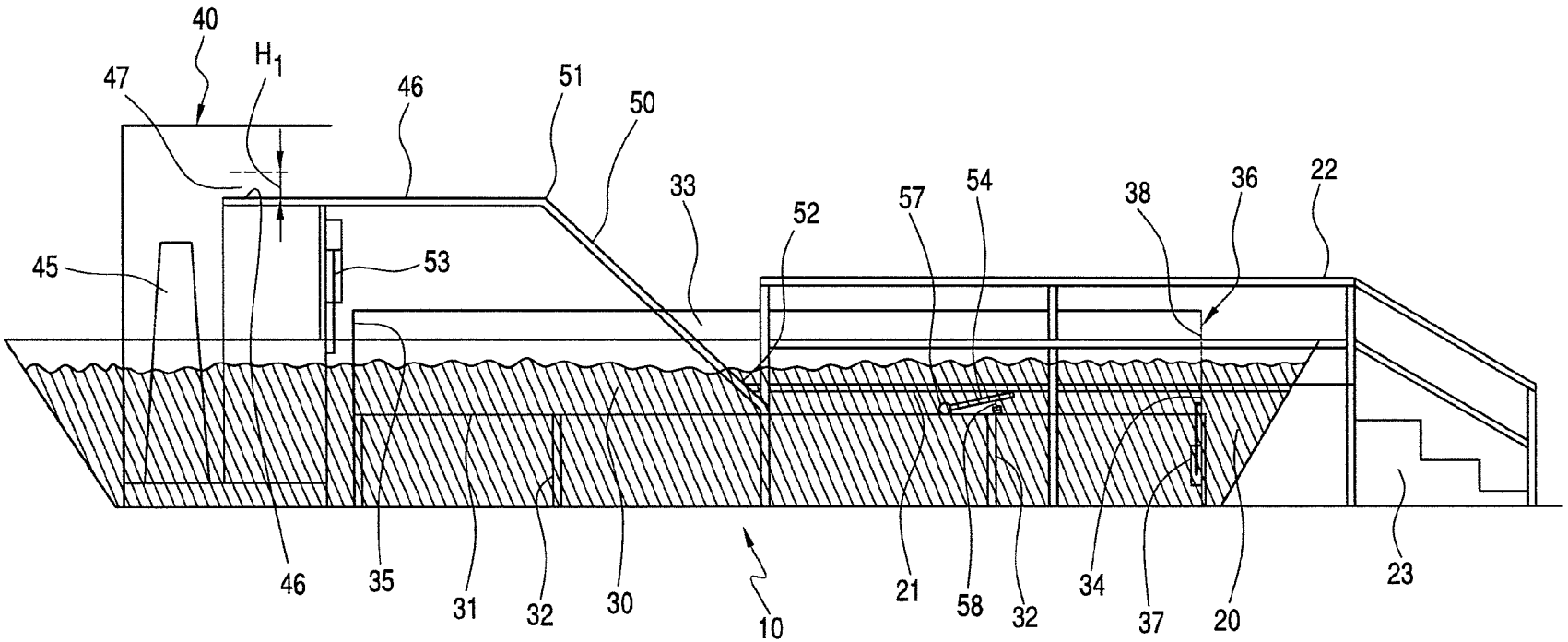
FIG. 1 shows a schematic longitudinal section through the surfing facility with the pumps turned off.
Figure 2:
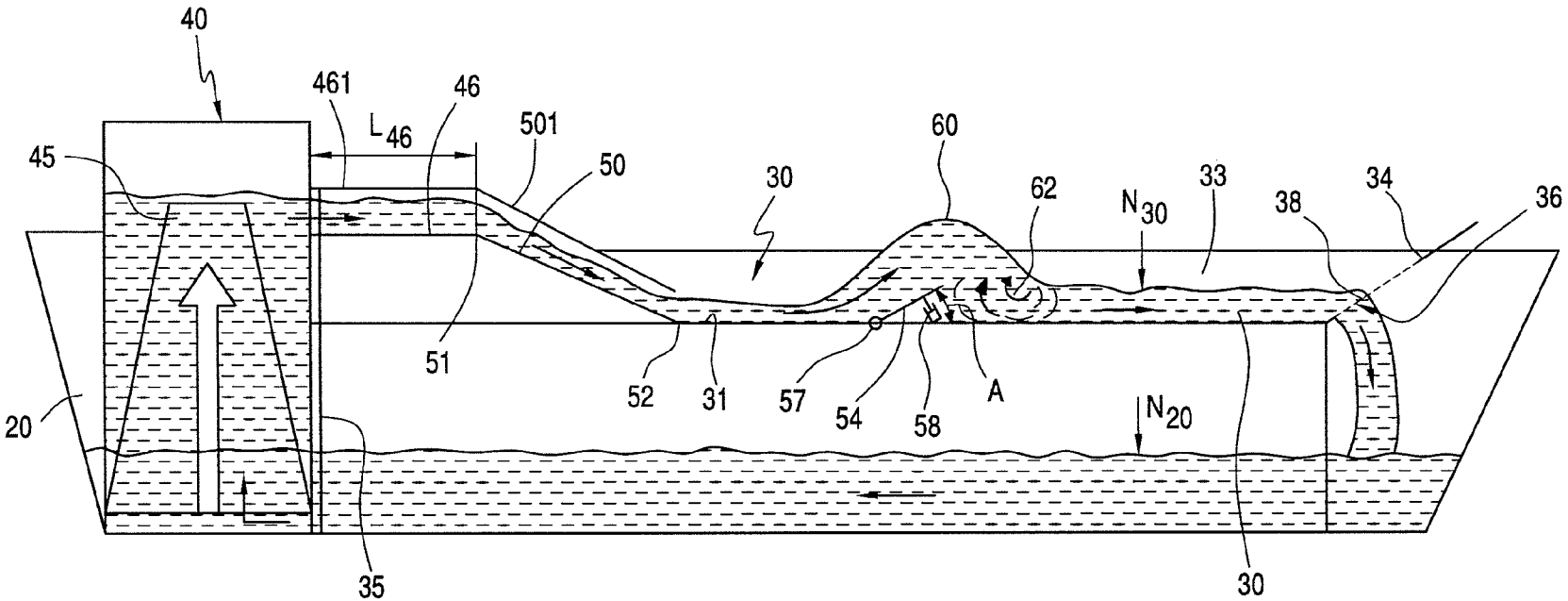
Figure 3:
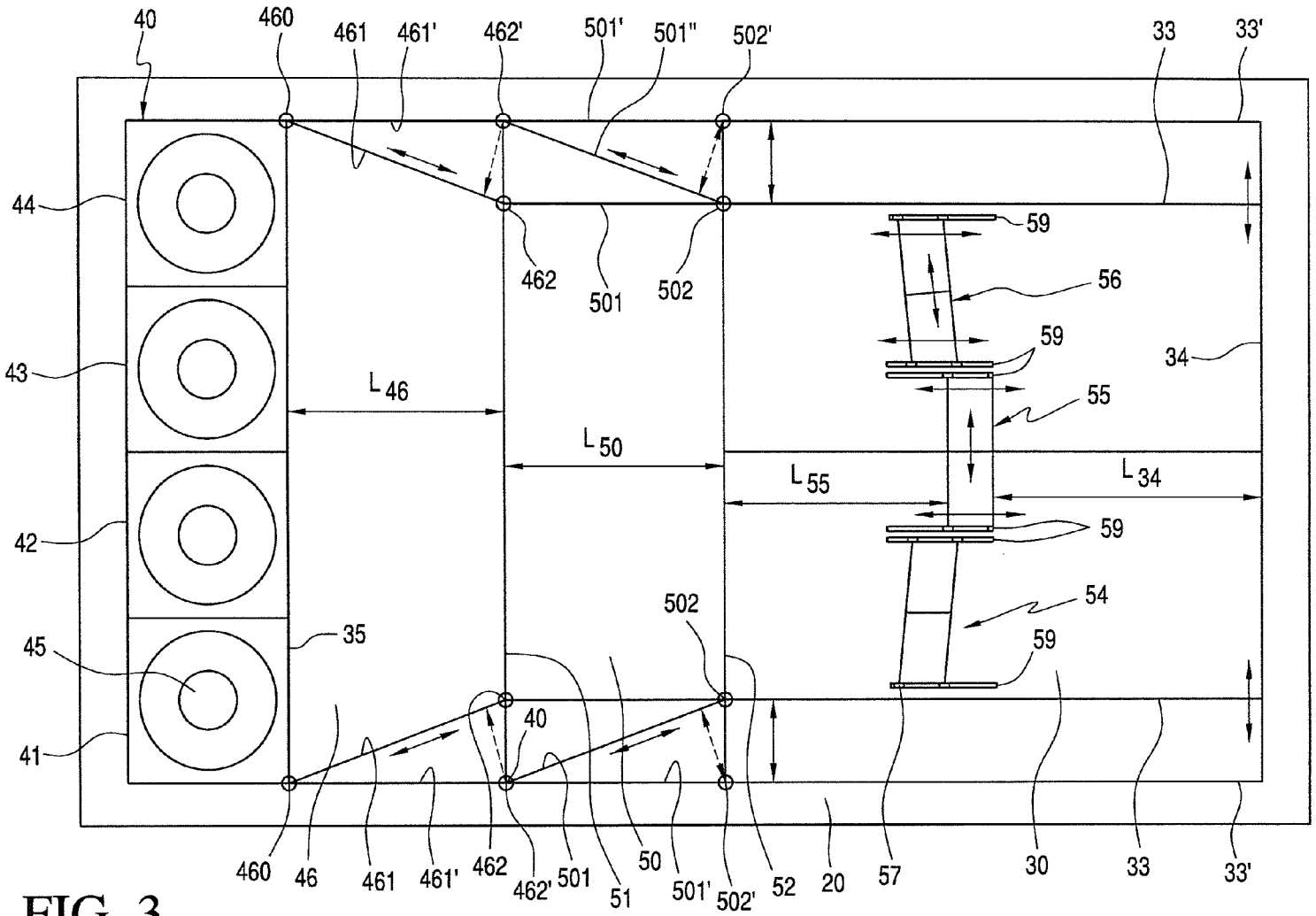
FIG. 3 shows a schematic top view of the surfing facility.

The figures are purely schematic and should in no case be regarded as to scale. The surfing facility 10 shown in FIGS. 1 to 3 is formed by a trough-shaped main pool 20 which holds all other components and keeps the water necessary for operation of the surfing facility 10 in a closed circuit. Within the main pool 20, opposite its bottom, is a wave pool 30 elevated on supports 32. The wave pool 30, aside from the part of the main pool 20 which is on the left in the figures, extends over most of the length and width of the main pool 20 (see, FIG. 2). However, as a result of the bottom 31 of the wave pool 30, which is elevated relative to the main pool 20, the wave pool 30 has a much lower depth. The water mass in the wave pool 30 is accordingly smaller than the total water mass of the main pool 20. The wave pool 30, on either side, is bordered by two side walls 30, by a rear wall 34 (shown on its right side) and by a front wall 35 (shown on its left side). In the rear wall 34, an overflow 36 is fowled via which water can flow back from the wave pool 30 into the main pool 20 (see, FIG. 2). The height of the lower edge of the overflow 36 is optionally adjustable by a doubled wall part which is adjustable relative to the rear wall 34 by means of a displacement mechanism 37 so that, in this way, the height of the water level $N_{30}$ of the wave pool 30, and thus, also the entire mass of water in the wave pool 30 can be changed.

In the part of the main pool 20, which is shown in the left part of FIGS. 1 to 3, into which pool the wave pool 30 does not extend, there is a pump system 40 which is composed of four pump units 41, 42, 43, and 44 which are arranged next to one another in the transverse direction. Each of the pump units 41, 42, 43, and 44 comprises a high performance pump 45 which delivers volumetrically, which intakes water from the bottom area of the main pool 20 and forces it up. The pump units 41, 42, 43, and 44 are closed on three sides and on the fourth side are connected via a discharge opening 47 to a preferably horizontally arranged flow section 46 on which the water conveyed by the pump 45 is homogenized in a relatively large flow section 46 which has a length $L_{46}$.

The side of the flow section 46 facing the wave pool 30 is adjoined by the upper bearing 51 of a ramp 50 which descends obliquely down to the bottom of the wave pool 30. Thus, the lower end 52 of the ramp 50 is in the water of the wave pool 30. Preferably, there is a fixed arrangement of the ramp 50. The length $L_{50}$ of the ramp 50 is roughly half as large as the length $L_{46}$ of the flow section 46.

Figure 5:
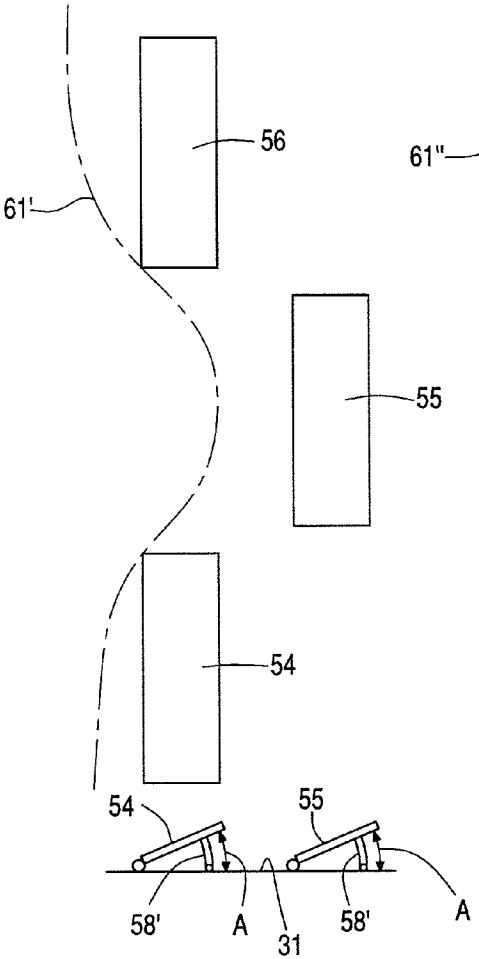
FIG. 5 shows a second arrangement of several guide devices which is aligned transversely to the flow offset to one another.
Figure 4:
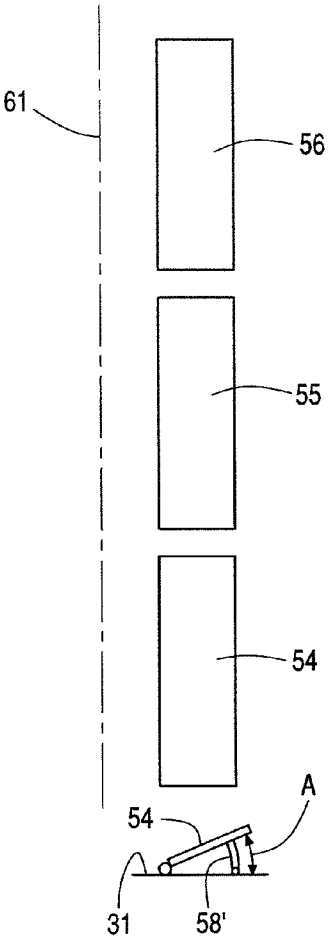
FIG. 4 shows a first arrangement of several guide devices which are aligned transversely to the flow on a line.

At a distance $L_{55}$ in a downstream direction from the lower end 52 of the ramp 50, there is at least one adjustable guide device that extends in the flow direction. The guide device is formed, according to a first embodiment, by guide profiles 54, 55, 56 which are on the bottom 31 of the wave pool 30 and have an angle of inclination with respect to the flow A which can be adjusted by means of an adjusting mechanism 58. At least in a portion of its pivoting region, the guide profiles 54, 55, 56 can be supported to be adjustable in a freely floating and/or mechanically adjustable manner with respect to the flow. The adjusting mechanism 58 preferably comprises a pneumatic cylinder which is located between a bearing site near the bottom 31 of the wave pool 30 and a coupling near the rear edge on the bottom of the guide profile 54, 55, 56 as shown in FIGS. 1 & 2. In an arrangement of the rear edge of the guide profile 54, 55, 56, which arrangement is freely floating at least in the end region, the maximum raising angle A of the profile is limited, for example, by a belt 58' attached to the bottom 31 as shown in FIGS. 4 & 5.

The guide profile 54, 55, 56 can be arranged at various different positions, and movement thereof is facilitated by there being several holding device or guides 59 on the bottom of the wave pool (FIG. 3) which movably support the guide profiles 54, 55, 56.

Another possibility of influencing the amount of water and flow velocity on the ramp 50—and thus, the shape and size of the standing wave 60—is to arrange the side walls 461 of the flow section 46 to form a constriction in the flow direction (see items 460, 462 in FIG. 3). Here, the side walls 501 are moved in the region of the ramp 50 such that they are matched to the constriction at the outlet of the flow section 46 in the region of the upper bearing 51 (see, items 462, 502 in FIG. 3). Optionally, the constriction—as indicated in FIG. 3 by items 462', 502'—can also take place in the region of the ramp 50. The flow section 46, in this case, has parallel side walls 461'. For a constriction in the region of the flow section 46 and/or in the region of the ramp 50, the width of the wave pool 30 is also matched thereto by relative displacement of its side walls 33.

On the overflow 36, there is a screen 38 for safety reasons so that it is ensured that only water flows back from the wave pool 30 into the main pool 20 and individuals who fall and are entrained by the flow in the wave pool 30, or articles lost by them, cannot be pulled into the main pool 20, and thus, into the intake region of the pumps 45.

As FIG. 1 shows, the region to the right and left of the wave pool 30 and on the other side of the rear wall 34 of the wave pool 30 can be crossed by footwalks 21. The footwalks 21 are protected by railings 22 and can be reached by steps 23 on an end or side of the main pool 20.

In the resting state of the surfing facility 10, as shown in FIG. 1, the total amount of water fills the main pool 20 and also the wave pool 30 located in it according to the height of the lower edge of the overflow 36. When the surfing facility 10 is operating according to FIG. 2, the pumps 45 start and very quickly deliver water from the main pool 20, via the discharge opening 47, to the flow section 46. From there, water flows onto the ramp 50 and with increasing speed and decreasing layer thickness down to the lower end 52 of the ramp 50. On the lower end 52, this fast flowing water strikes the water which is at rest relative to it in the wave pool 30. The water flowing down the ramp 50 is shaped by the guide profiles 54, 55, 56, which are used as wave initiators, supported by the inert mass of the almost standing water in the wave pool 30, upwardly into a standing wave 60 which is established in the wave pool 30 as a stationary state, and which thus forms a surfable wave. From the wave pool 30, the water flows through the screen 38 via the overflow 36 back into the main pool 20 and is again taken in there by the pumps 45 on the opposite face side of the main pool 20. The rear wall 34 of the wave pool 30 which houses the screen 38 is preferably made obliquely rising in the flow direction.

In the simplest case, the water mass present in the wave pool 30 is dynamically formed by the operation of the pumps 45 so that a physically defined overflow edge 36 to the main pool 20 is not necessary. In the rest state of the pumps 45, as shown in FIG. 1, the water level in the wave pool 30 corresponds to the water level in the main pool 20. As soon as the pumps 45 intake water from the main pool 20 and deliver it via the flow section 46 and the ramp 50 into the wave pool 30, the level $N_{20}$ of the water in the main pool 20 drops distinctly below the level $N_{30}$ of the water in the wave pool 30 so that, in any case, a defined overflow into the main pool 20 takes place. The water is delivered in a closed circuit from the main pool 20 into the wave pool 30 from where it runs back into the main pool 20.

The invention can be implemented on a mobile facility which has roughly the following dimensions and values: The main pool 20 is roughly 25 to 30 m long and roughly 12 m wide. The height of the water in the main pool 20 in the rest state of the pumps 45 is roughly 1.80 m. The wave pool 30 is roughly 20 to 25 m long and roughly 6 to 8 m wide. The bottom 31 of the wave pool 30 is roughly 1.50 m above the bottom of the main pool 20. The water height in the wave pool 30 is thus roughly 0.20 to 0.30 m in the rest state. In operation, the height of the water in the wave pool 30 upstream of the wave 60 is roughly 0.30 to 0.40 m and downstream of the wave 60 roughly 0.80 m. The ramp 50, in the narrowed state of the flow section 46, has a width of roughly 6.5 m. The layer thickness of the water flowing down on the ramp 50, depending on the set delivery rate of the pumps 45, is roughly between 0.50 m and 0.80 m. The flow velocity of the water on the lower end of the ramp 50 is up to 4.5 m/s. According to the increasing speed of the water when flowing down the ramp, its layer thickness decreases downward. The standing wave 60 reaches a height of roughly 1 m here.

For the mobility of the surfing facility 10, it is advantageous if at least parts of it, such as, for example, the pump units 41, 42, 43, 44 are formed by containers with standard dimensions, of which optionally several are connected to one another by interposed seals.

The pump system 40 has a total height of roughly 2.80 m. The four pump units 41, 42, 43, 44 have a width of 2 m each. Each pump delivers roughly 2 $m^3$ of water per second. The width of the flow section 46 tapers in its width between the inlet from the pump units 41, 42, 43, 44 and the upper end of the ramp 50 from 8 m to roughly 6.5 m. The length $L_{46}$ of the flow section 46 is roughly 6 m.

The ramp has a length $L_{50}$ of roughly 3 m to 3.5 m. The height difference between the top end 51 and the bottom end 52 of the ramp is roughly 0.30 m to 0.60 m.

The bottom end 52 of the ramp 50 is adjoined by the space in the wave pool 30 in which the standing wave 60 forms. The latter, in front of the guide profiles 54, 55, 56, has a length $L_{55}$ of roughly 2 m and behind them a length $L_{34}$ of roughly 3 to 4 m. At a length of roughly 3 to 4 m, a rear wall 34, in which the overflow 36 and the screen 38 are located, rises obliquely rearward. The guide profiles 54, 55, 56, themselves, have a length of roughly 25 cm.

Figure 6:
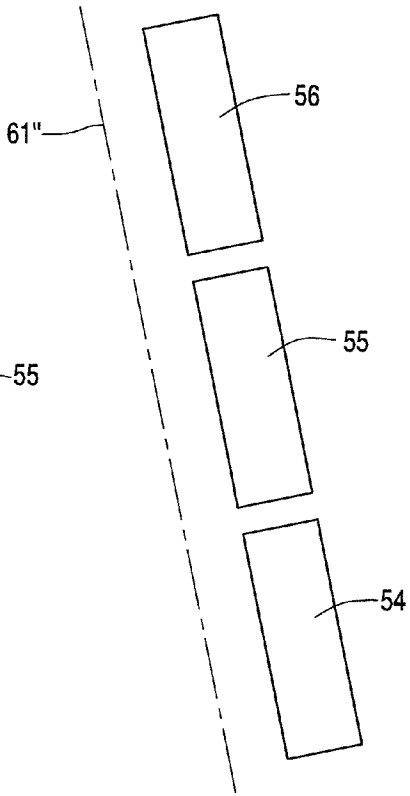
FIG. 6 shows a third arrangement of several guide devices which are aligned obliquely to the flow.

FIGS. 4 to 6 show three examples for a wave shape 61 which can be achieved by different arrangements of the guide profiles 54, 55, 56. The wave shape 61 reproduces schematically the crest of the arising wave 60 in a top view.

In FIG. 4, all three guide profiles 54, 55, 56 are parallel to one another in a line. The wave crest which is formed in the wave pool 30, accordingly, is perpendicular to the flow direction or to the side walls 33.

In FIG. 5, the middle guide profile 55 is somewhat farther away from the lower end 52 of the ramp 50 than the two outer guide profiles 54, 56. The shape of the wave thus assumes the illustrated curved wave shape 61' with a bulge in the flow direction in the middle region. When surfing on such a wave relative acceleration when travelling toward the middle and relative deceleration when travelling from the middle to the outside take place.

In FIG. 6, all three guide profiles 54, 55, 56 are parallel to one another on a line which is at an oblique angle relative to the flow direction or to the side walls 33. The wave shape 61" which result follows this angle and when surfing causes relative acceleration when travelling in the direction to the right guide profile 54 and relative deceleration when travelling in the opposite direction.

The illustrated examples constitute only a small selection of possible wave shapes 61 which can be produced. More or less than the three illustrated guide profiles are also possible so that a host of wave shapes 61 is possible beyond the illustrated examples such as partially straight and/or partially sloped arrangement and/or arrangement partially offset to one another.

The guide profiles 54, 55, 56 can optionally be telescopically adjusted in their width. This can be easily achieved by an at least partial double wall, on at least one of the wall parts there being guide means for relative displacement of the other wall part.

For changing the flow width, when the side walls 461 can be moved in the region of the flow section 46, the side walls 501 in the region of the ramp 50 and the side walls 33 in the region of the wave pool 30, the side walls 461, 501 and possibly also the front wall 34 of the wave pool 30 are advantageously made variable in their length by telescoping. The principle of a wall which can be telescopically lengthened is known, for example, from baking sheets or baking forms of variable size (see for example DE 299 17 103 U1, DE 94 00 662 U1, or DE 88 05 174 U1) and therefore will not be explained in detail.

Figure 7:
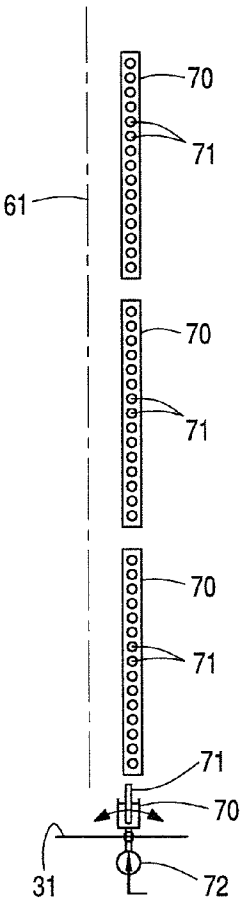
FIG. 7 shows a version in which the guide devices are formed by nozzles or nozzle strips.

Instead of the guide profiles 54, 55, 56 or in addition to them, for promotion of the formation of a standing wave 60, nozzles 71 can also be used as guide devices which are arranged either on the guide profiles 54, 55, 56 or as shown in FIG. 7 on nozzle strips 70 which are preferably pivotally arranged on the bottom 31 of the wave pool 30. The nozzles 71 are fed by one or more pumps 72 which can be controlled or adjusted in their delivery, which intake water from the main pool 20 and which deliver it to the nozzles 71 at a high pressure which can be varied by means of the pump delivery. The water jet which is emerging from the nozzles and which has a vertical component relative to the main flow in the wave pool 30 promotes the formation of the wave 60 in a manner similar to the guide profiles 54, 55, 56. The nozzle strips 70 can, accordingly, be located not only on a line transversely to the main flow in the wave pool 30, as shown in FIG. 7, but can also assume the arrangements or mixed forms shown in FIGS. 5 and 6. Due to the pivoting arrangement of the nozzles 71 or nozzle strips 70 relative to the bottom 31 of the wave pool, they can then be pointed not only vertically up, but also at any angle to the main flow—opposite to or in the direction thereof.

What is claimed is:

1. Artificial surfing facility for producing a standing wave, comprising:

a main pool, a wave pool, a inclined ramp, a lower end of which discharges into the wave pool, a flow section connected at an outlet end thereof to an upper end of the ramp, at least one pump connected to an inlet end of the flow section by means of which water is conveyed from the main pool to the flow section, at least one adjustable guide device in the wave pool at a distance downstream from the lower end of the ramp, wherein the wave pool is positioned above the main pool, wherein the at least one pump unit, during operation, being adapted to produce a liquid level in the wave pool sufficient to produce a defined resistance to water flowing down the ramp which will enable formation of the standing wave at the at least one adjustable guide device by a change of the flow velocity of the water, and an overflow via which water is able to flow back from the wave pool into the main pool, the overflow being provided with an adjusting mechanism that enables the water level in the wave pool to be regulated in a manner enabling, in a resting state, retaining of a total amount of water to fill the main pool and wave pool to a level sufficient to provide said defined resistance upon commencement of operation.

2. Surfing facility as claimed in claim 1, wherein the flow section has side walls which are positioned to produce a narrowing of the flow width of the water in a direction to the lower end of the ramp.

3. Surfing facility as claimed in claim 1, wherein said at least one pump unit comprises a plurality of pump units, each of which have a pump, the wave pool and the pump units being surrounded by the main pool.

4. Surfing facility as claimed in claim 3, wherein the total amount of water delivered to the flow section is regulatable by controlling output of at least one of the pumps.

5. Surfing facility as claimed in claim 1, wherein the at least one guide device comprises a plurality of adjacent guide devices extending widthwise of the wave pool.

6. Surfing facility as claimed in claim 1, wherein the guide devices are guide profiles which have a front edge which is directed opposite a direction of water flow and which are supported to pivot around a pivot bearing located at a downstream end of the profiles.

7. Surfing facility as claimed in claim 6, wherein an adjusting mechanism is provided for pivoting the profiles around the pivot bearing so as to adjust an angle of incidence of the profiles relative to the water flow.

8. Surfing facility as claimed in claim 6, wherein the profiles are supported in a manner enabling free floating of the front edge thereof at least in a predefined pivoting region.

9. Surfing facility as claimed in claim 5, wherein the guide profiles are located at different positions relative to each other in a lengthwise direction of the wave pool.

10. Surfing facility as claimed in claim 1, wherein the ramp has side walls which are movable relative to one another for changing the width of water flowing therebetween.

11. Surfing facility as claimed in claim 1, wherein the wave pool has side walls which are movable relative to one another for changing the width of water flowing therebetween.

12. Surfing facility as claimed in claim 1, wherein a distance of the guide profiles from the lower end of the ramp is approximately equal to the length of the ramp.

13. Surfing facility as claimed in claim 1, wherein at least one guide device comprises at least one nozzle or nozzle strip which produces a water flow with a component which is perpendicular to the flow of water in the wave pool from the ramp.

14. Surfing facility as claimed in claim 5, further comprising holding devices or guides on the bottom of the wave pool which movably support the guide devices in a positionally adjustable manner so that the guide devices can be arranged in various different positions.

15. Surfing facility as claimed in claim 14, wherein at least one nozzle or nozzle strip is pivotally arranged on the bottom of the wave pool.

16. Surfing facility as claimed in claim 13 wherein the at least one nozzle or nozzle strip is pivotally arranged on the bottom of the wave pool.

17. Surfing facility as claimed in claim 16, wherein the at least one nozzle or nozzle strip is fed by one or more pumps which can be controlled or adjusted in their delivery.

18. Surfing facility as claimed in claim 13, wherein the at least one nozzle or nozzle strip is arranged at an angle opposite to the main flow.

* * * * *

US008516624C1

(12) EX PARTE REEXAMINATION CERTIFICATE (10875th)

United States Patent
Klimaschewski

(10) Number: US 8,516,624 C1
(45) Certificate Issued: Jun. 6, 2016

(54) ARTIFICIAL SURFING FACILITY

(75) Inventor: Rainer Klimaschewski, Gräfelfing (DE)

(73) Assignee: ACTION TEAM VERANSTALTUNGS GMBH, Martinsried (DE)

Reexamination Request:
No. 90/013,564, Aug. 12, 2015

Reexamination Certificate for:

| | |
|---|---|
| Patent No.: | **8,516,624** |
| Issued: | **Aug. 27, 2013** |
| Appl. No.: | **13/002,586** |
| PCT Filed: | **Nov. 17, 2009** |
| PCT No.: | **PCT/EP2009/008177** |
| § 371 (c)(1), (2), (4) Date: | **Jan. 4, 2011** |
| PCT Pub. No.: | **WO2010/054850** |
| PCT Pub. Date: | **May 20, 2010** |

(30) Foreign Application Priority Data

Nov. 17, 2008 (DE) ..... 10 2008 057 785

(51) Int. Cl.

| | |
|---|---|
| ***A47K 3/10*** | (2006.01) |
| ***E02B 3/00*** | (2006.01) |
| ***E02B 13/00*** | (2006.01) |
| ***A63G 9/00*** | (2006.01) |
| ***A63G 31/00*** | (2006.01) |

(52) U.S. Cl.
CPC ..... *A63G 31/007* (2013.01); *A63B 2208/03* (2013.01)

(58) Field of Classification Search
None
See application file for complete search history.

(56) References Cited

To view the complete listing of prior art documents cited during the proceeding for Reexamination Control Number 90/013,564, please refer to the USPTO's public Patent Application Information Retrieval (PAIR) system under the Display References tab.

*Primary Examiner* — Jeffrey L Gellner

(57) ABSTRACT

An artificial surfing facility for producing a standing wave, with an inclined ramp, to the upper end of which water is conveyed by at least one pump and at the lower end of which the water discharges into a wave pool. A standing wave is easily attained by there being an adjustable guide device in the wave pool at a distance from the bottom end of the ramp in the flow direction as a wave initiator. The wave pool, during operation of at least one pump, has a liquid level which is located above the liquid level of a main pool which surrounds the wave pool and the amount of water in the wave pool offers a defined resistance to the water flowing down the ramp so that the formation and height of the standing wave are influenced by the change of the flow velocity.

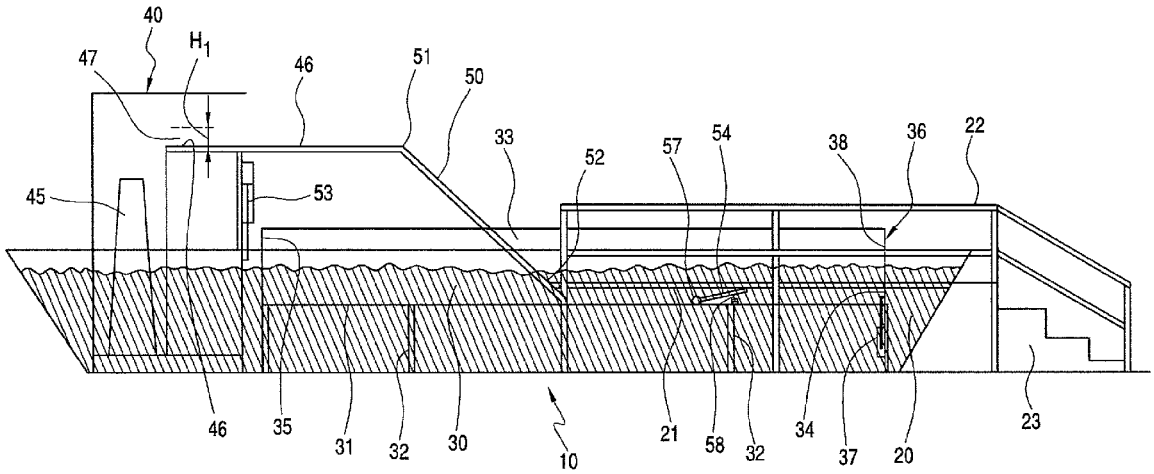

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2-18, dependent on an amended claim, are determined to be patentable.

1. Artificial surfing facility for producing a standing wave, comprising:

a main pool, a wave pool, [a] *an* inclined ramp, a lower end of which discharges into the wave pool, a flow section connected at an outlet end thereof to an upper end of the ramp, at least one pump connected to an inlet end of the flow section by means of which water is conveyed from the main pool to the flow section, at least one adjustable guide device in the wave pool at a distance downstream from the lower end of the ramp, wherein the wave pool is positioned above the main pool, *the main pool being larger than the wave pool,* wherein the at least one pump unit, during operation, being adapted to produce a liquid level in the wave pool sufficient to produce a defined resistance to water flowing down the ramp which will enable formation of the standing wave at the at least one adjustable guide device by a change of the flow velocity of the water, and an overflow *located in the rear wall of the wave pool* via which water is able to flow back from the wave pool into the main pool, the overflow being provided with an adjusting mechanism that enables the water level in the wave pool to be regulated in a manner enabling, in a resting state, retaining of a total amount of water to fill the main pool and wave pool to a level sufficient to provide said defined resistance upon commencement of operation *so that the formation and height of the standing wave are influenced by the change of the flow velocity of the water*.

* * * * *